US006016910A

United States Patent [19]

Rodearmel

[11] Patent Number: 6,016,910

[45] Date of Patent: Jan. 25, 2000

[54] SPORTS MEMORABILIA DISPLAY STAND

[76] Inventor: John Rodearmel, 5 Carriage Dr., Stonington, Conn. 06378

[21] Appl. No.: 09/030,474

[22] Filed: Feb. 25, 1998

[51] Int. Cl.[7] ..... B65D 85/00; G09F 19/00

[52] U.S. Cl. ..... 206/315.9; 206/315.1; 428/13

[58] Field of Search ..... 206/315.9, 315.1, 206/579; 428/11, 13, 542.4

[56] References Cited

U.S. PATENT DOCUMENTS 5,070,755 12/1991 Carroll .
5,082,110 1/1992 Hager .
5,165,538 11/1992 Peters .
5,286,535 2/1994 Hou ..... 428/11

*Primary Examiner*—Jim Foster
*Attorney, Agent, or Firm*—Alix, Yale & Ristas, LLP

[57] ABSTRACT

A device for displaying sports memorabilia having a base member and a memorabilia holder extending outwardly from a display surface of the base member. A music box may also be mounted to the base member. At least one of the base member, holder or music box comprises indicia associated with the memorabilia to provide an enhanced sensory experience for the viewer. Such indicia includes shapes, decorations and sounds related to the sport of the memorabilia.

20 Claims, 4 Drawing Sheets

SPORTS MEMORABILIA DISPLAY STAND

BACKGROUND OF THE INVENTION

This invention relates generally to devices used to hold memorabilia for display purposes. More particularly, the present invention relates to devices used to hold sports memorabilia such as baseballs, softballs, basketballs, golf balls, soccer balls, hockey pucks, boxing gloves, and the like. It is not uncommon for sports fans, athletes and others to display sports memorabilia, such as autographed balls. Usually such memorabilia are displayed in a manner that advantageously positions the autograph for viewing.

The exterior surface of the sports memorabilia and autographs located thereon may be damaged during handling of the memorabilia by a viewer. Many conventional display devices are primarily comprised of a transparent housing that prevents a viewer from directly handling the memorabilia and thereby prevents handling damage. Such display devices may also help protect the memorabilia from environmental degradation. The display devices are generally "generic". That is, such display devices generally do not include any indicia to identify the type of sports memorabilia which will be displayed. With the exception of differences in height, width and length, display devices intended to display one type of memorabilia are essentially indistinguishable from devices which are intended to display another type of memorabilia. Although devices of this type protect the memorabilia and may allow a single display device to display a number of different kinds of memorabilia, they do not enrich the sensory experience of viewing the memorabilia.

Some conventional display devices are designed to enrich the sensory experience of the viewer in addition to displaying the memorabilia. For example, baseball/softball display devices are available which comprise a holder having the shape of a baseball glove.

Generally, holders of this type must be mounted within a transparent housing of the type described above to prevent handling damage.

SUMMARY OF THE INVENTION

Briefly stated, the invention in a preferred form is a display device for displaying sports memorabilia which includes a base member having oppositely disposed first and second surfaces. The second surface is adapted to rest adjacent a separate surface. A holder for holding the memorabilia is mounted to the base member adjacent the first surface. A music box is also mounted to the base member. At least one of the base member, holder or music box comprises indicia associated with the memorabilia to provide an enhanced sensory experience for the viewer.

The base member may have a shape and/or one or more surfaces that are decorated in a manner that is associated with the sport to which the displayed memorabilia is related. For example, the base member of a baseball display device may have the shape and colors of a home-plate. The holder may have a shape associated with the sport to which the displayed memorabilia is related. For example, the holder of a baseball display device may have the shape of a baseball glove. The music box may play music associated with the sport to which the displayed memorabilia is related. For example, the music box of a baseball display device may play Take Me Out To The Ball Game.

It is an object of the subject invention to provide an improved display device for sports memorabilia.

It is another object of the subject invention to provide a sports memorabilia display device that provides an enhanced sensory experience for the viewer of the memorabilia.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
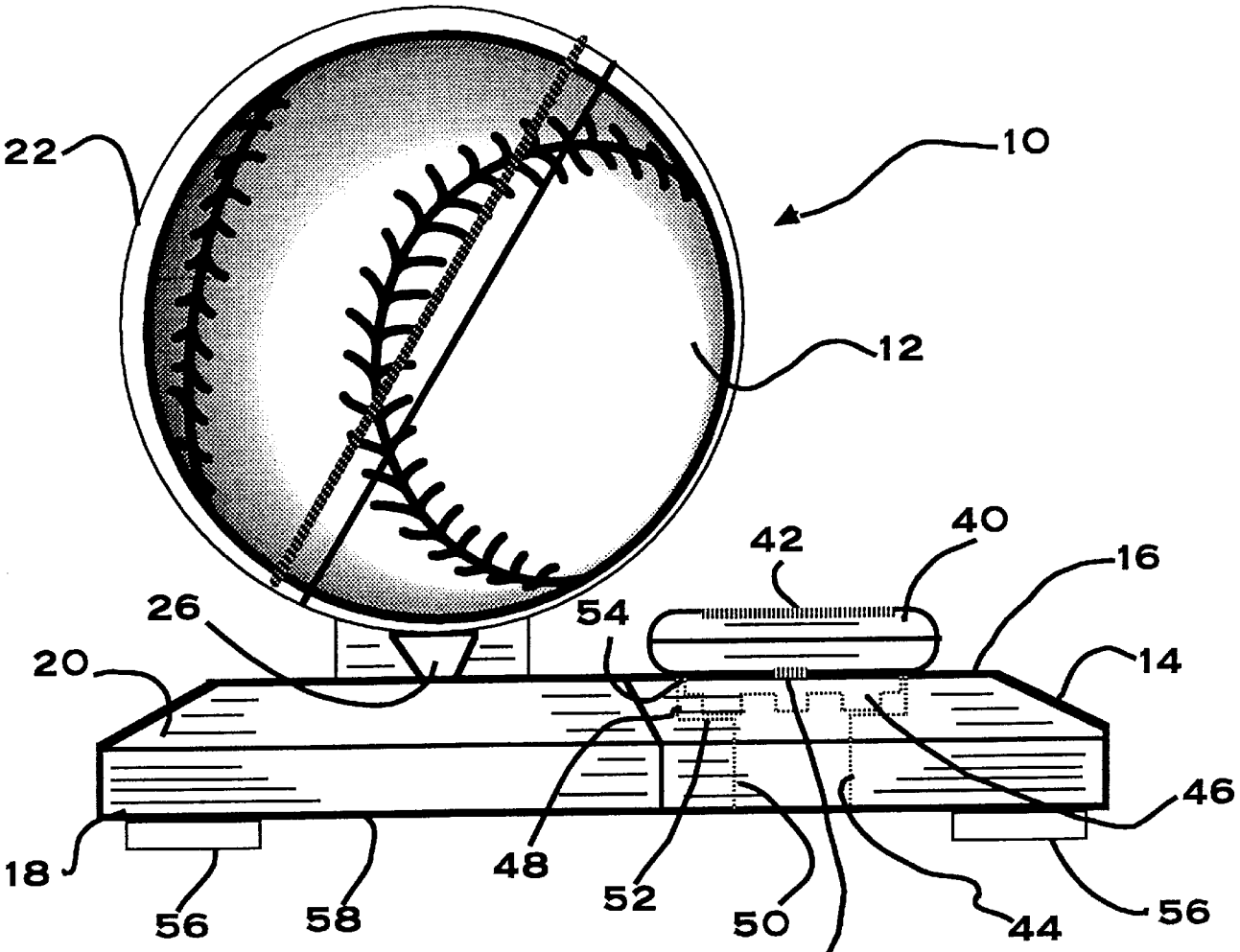
FIG. 1 is a side elevational view, partly in phantom, of a first embodiment of a display stand in accordance with the invention having a transparent globular baseball holder mounted to a home-base shaped base member with a baseball mounted in the holder.

With reference to the drawings wherein like numerals represent like parts throughout the several figures, a display device for sports memorabilia in accordance with the present invention is generally designated by the numeral 10. The display device 10 includes one or more features that are indicia associated with the specific type of sports memorabilia which will be displayed. For example, the display device 10 shown in FIG. 1 is intended to display either a baseball 12 or a softball. The base member 14 of display device 10 has the five-sided shape and beveled edges that are characteristic of the home-plate that is used in these two sports. Using a display device 10 that establishes a setting that is associated with the specific sports memorabilia enriches the sensory experience of the viewer.

Figure 5:
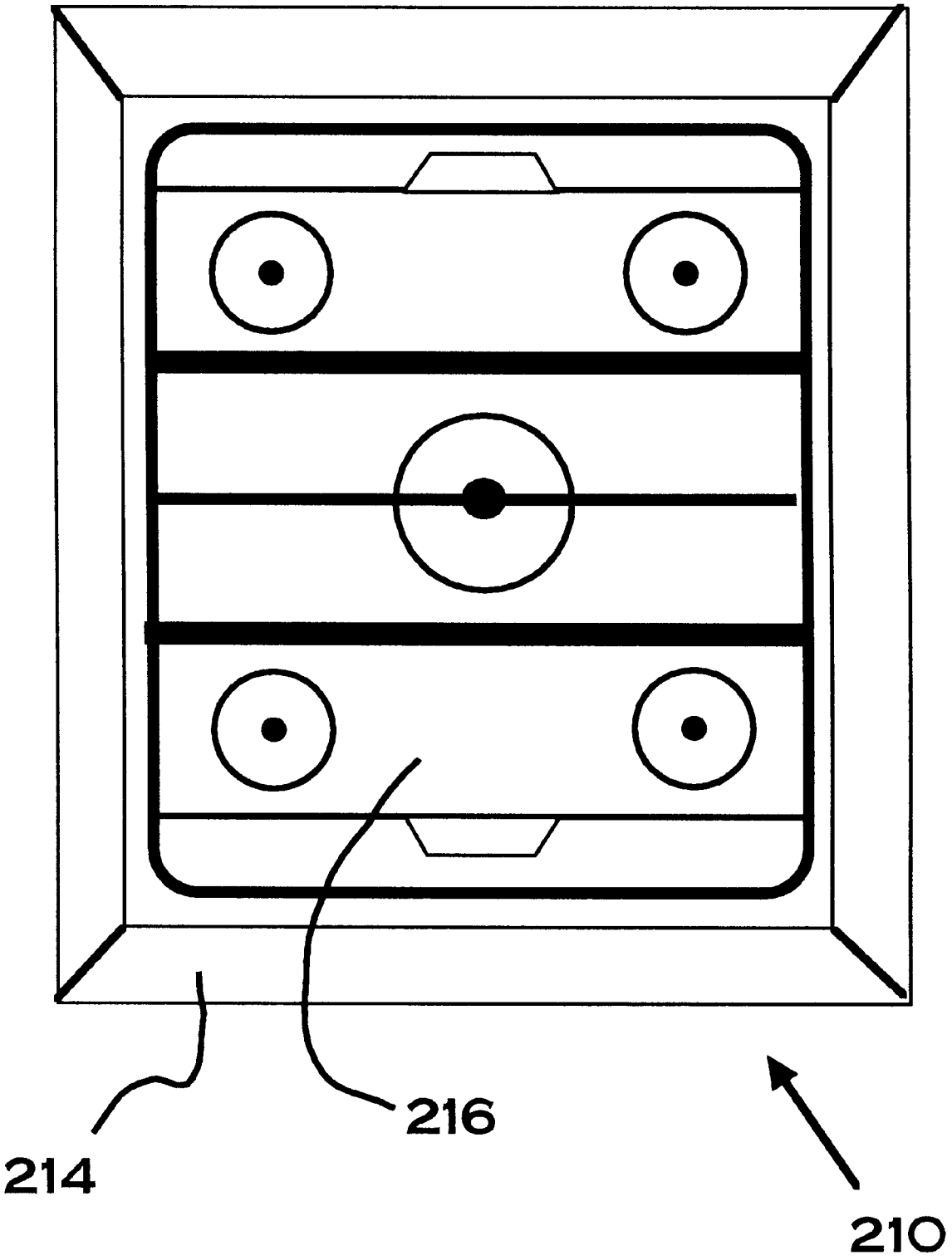
FIG. 5 is a top view of a base member of a third embodiment of a display stand in accordance with the invention having a display surface decorated with indicia associated with ice hockey.

As described above, the display device 10 includes a base member 14 which may have a shape and/or has one or more display surfaces that are decorated in a manner that is associated with the sport to which the displayed memorabilia is related. In addition to having the shape of a home-plate, the top, or display surface 16 of base member 14 shown in FIG. 1 may be colored white and the side surfaces 18 and beveled surfaces 20 may be colored black, like a home-plate. Alternatively, the base member 14 for a baseball display device 10 may also be shaped and decorated to resemble a baseball diamond or the playing field of a well known baseball park such as Yankee Stadium or Fenway Park. Similarly, the base members 14 of display devices 10 for other sports memorabilia may be shaped and/or colored in a manner that is associated with the specific memorabilia which will be displayed. For example, the base member 214 of a hockey puck display device 210 may be rectangular and the display surface 216 may be decorated with blue lines, red lines, face-off circles, and other such markings which are associated with hockey rinks, as shown in FIG. 5. Base members 14 may have the shape and decorations of football fields, soccer fields, basket ball courts, boxing rings, famous golf holes, and the like. Base members 14 may also be decorated with specific team logos.

Figure 2:
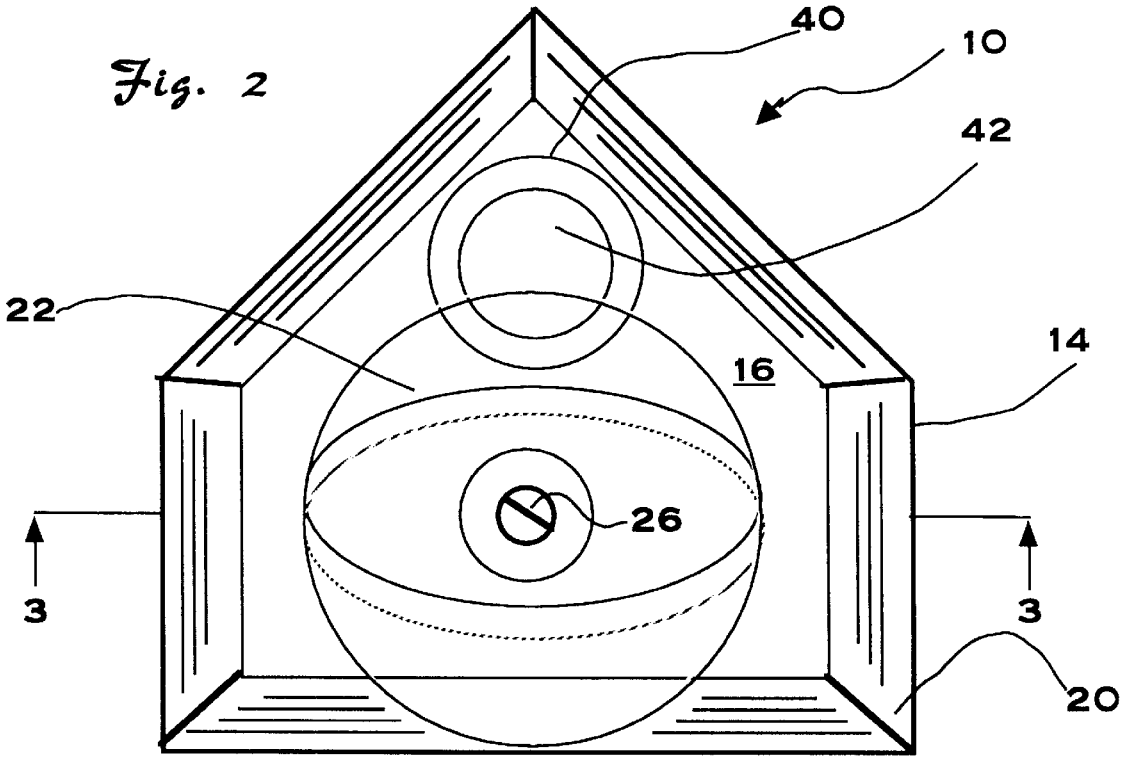
FIG. 2 is a top view of the display stand of FIG. 1.

A holder 22 is mounted to the base member 14 and extends upwardly from the display surface 16. Depending on the type of sports memorabilia and the type of holder 22, the sports memorabilia is placed on or within the holder 22 to mount the sports memorabilia to the display device 10. For example, with reference to FIGS. 1–3, the holder 22 for baseball display device 10 preferably comprises a transparent sphere. Such spheres are well known in the art and may include the baseball holder of U.S. Pat. No. 5,165,538. Generally, such spheres are comprised of two hemispheres that are joined along their circumferential edges by a slip fit. Such holders completely enclose the memorabilia to protect it from handling damage and environmental degradation. Similar transparent holders 22 may be utilized for other sports memorabilia. Alternatively, holders 22 having an association with the specific sports memorabilia to be displayed may be mounted to the base member. For example, a holder 122 having the shape of a baseball glove (FIG. 4) may be used for a baseball or a softball display device 110, a kicking tee may be used to hold a football, or a golf tee may be used to hold a golf ball.

Figure 3:
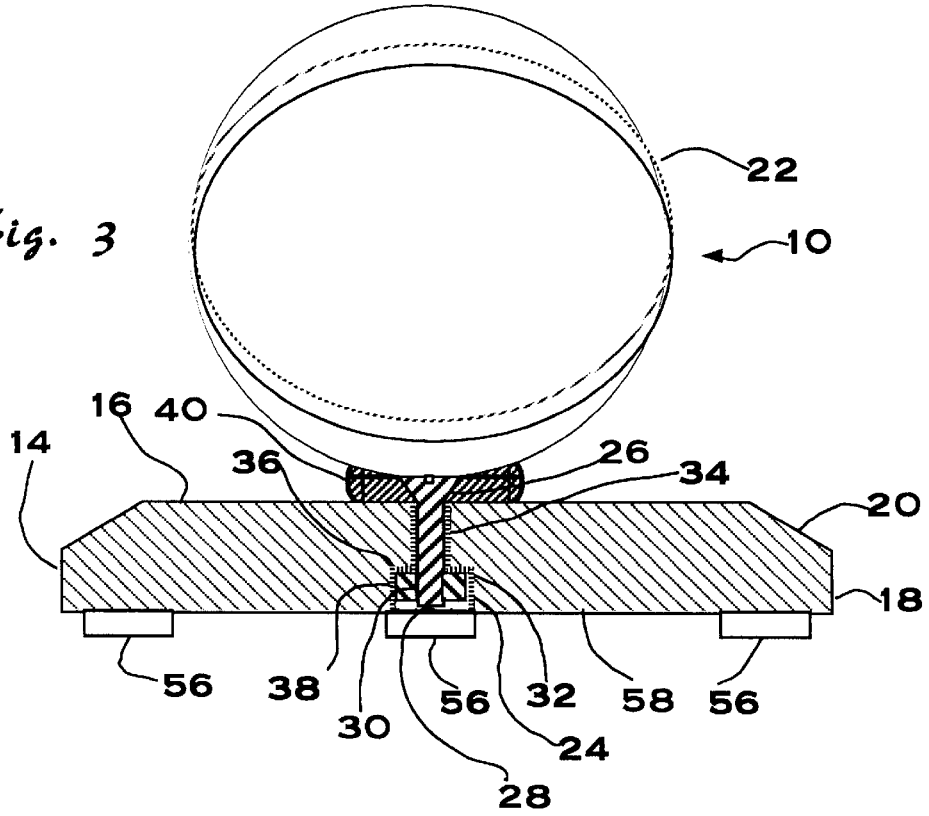
FIG. 3 is a cross-sectional view of the holder taken along line 3—3 of FIG. 2.

The holder 22 is mounted to the base member 14 in a manner which is suitable for each type of holder 22. Some commercially available holders 22 have an opening shaped for receiving the head 26 of a bolt 30 or screw. As shown in FIG. 3, the base member 14 preferably includes a first opening 24 for receiving the shaft 28 of the bolt 30 for mounting such a holder 22 to the base member 14. The inside diameter of the lower portion 32 of the opening 24 is greater than the inside diameter of the upper portion 34 to define a shoulder 36 which limits the upward movement of the nut 38 which is mounted to the shaft 28 within the opening lower portion 32.

A display device 10 in accordance with the invention preferably includes a music box 40 which plays music that is associated with the specific sports memorabilia to be displayed. For example, the baseball/softball display device 10 of FIGS. 1 and 4 may include a music box 40 that plays "Take Me Out To The Ball Game", a display device 10 for a boxing glove may include a music box that plays the theme from "Rocky", or a display device 10 for an Olympic medal may include a music box that plays the Olympic theme. Alternatively, the display device 10 may include a music box that plays the "fight song" for a specific college or university.

Preferably, the music box 40 is of the type disclosed in U.S. Pat. No. 5,070,755. Such a music box 40 has an upper depressable surface 42 for pressure actuating a computer chip storing the music and associated circuitry and speaker for producing the music. As shown in FIG. 1, the base member 14 includes a second opening 44 for receiving the leg portion 46 of the music box 40. The inside diameter of the upper portion 48 of the opening 44 is greater than the inside diameter of the lower portion 50 to define a shoulder 52. Preferably, lower surface 54 and leg portion 46 of the music box 40 are mounted to the base member 14 by glue or similar means. The shoulder 52 facilitates positioning of the music box 40 and also provides an additional surface for bonding to the leg portion 46 of the music box 40. The music box speaker projects the music out of the bottom of the music box through the lower portion 50 of the second opening 44.

Figure 4:
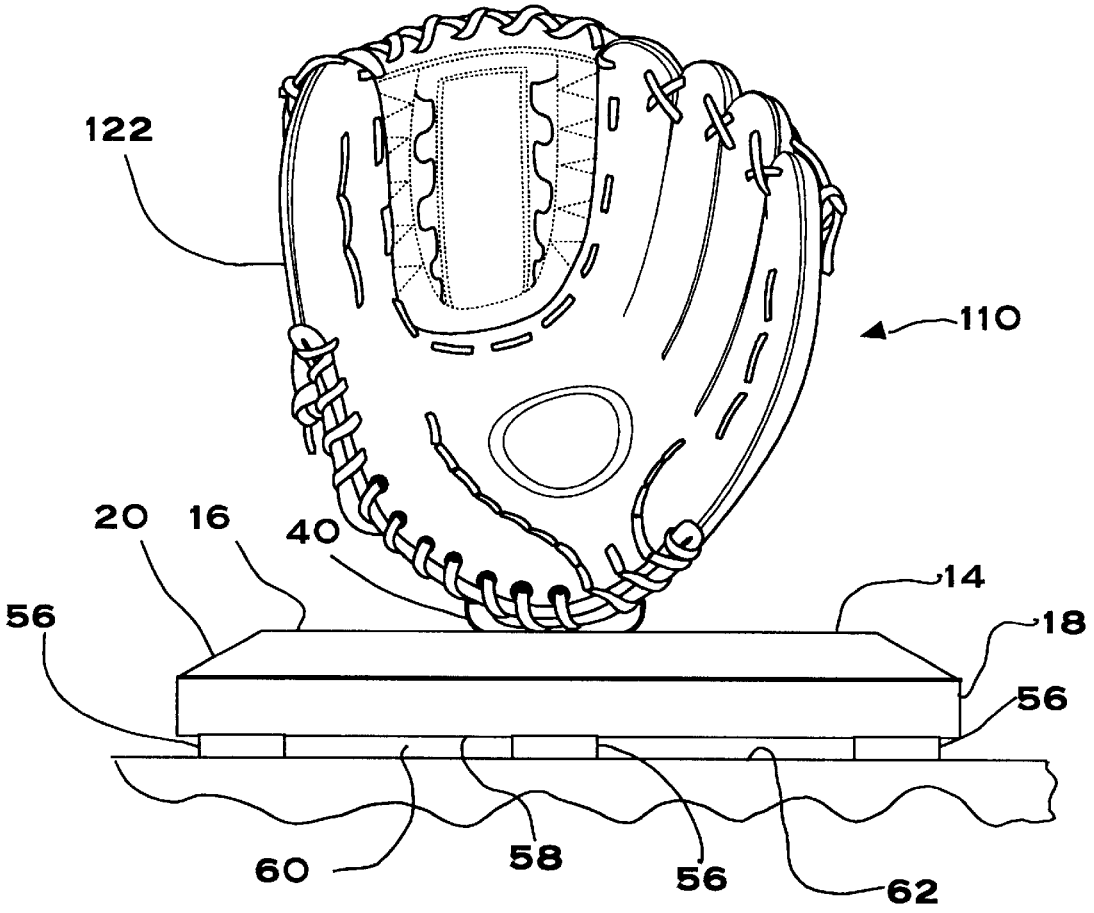
FIG. 4 is a front elevational view of a second embodiment of a display stand in accordance with the invention having a baseball glove shaped holder mounted to a home-base shaped base member.

A plurality of pads 56 are mounted to the bottom surface 58 of the base member 14 at spaced intervals. As shown in FIG. 4, the thickness of the pads 56 is selected to provide a resonance cavity 60 between the bottom surface 58 and the separate surface 62 on which the display device 10 rests. The distance between each of the pads 56 is selected to ensure that the music will be emitted from the resonance cavity 60 without interference. Preferably, the pads 56 are composed of a resilient material such as rubber or a soft material such as felt.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A display stand for displaying sports memorabilia comprising:

a base member having oppositely disposed first and second surfaces, said second surface being adapted to rest adjacent a separate surface;

holder means mounted to said base member adjacent said first surface for holding the memorabilia; and music box means mounted to said base member and operable from said first surface for producing music;

wherein at least one of said base member, said holder means or said music comprises indicia associated with said memorabilia.

2. The display stand of claim 1 wherein said base member defines a first opening traversing said first and second surfaces.

3. The display stand of claim 2 wherein said music box means comprises transmitter means for transmitting said music and actuating means for actuating production of said music, said music box means being mounted such that said actuating means is disposed adjacent said first surface and said transmitting means is positioned for transmitting said music through said first opening.

4. The display stand of claim 3 further comprising pad means mounted to said second surface of said base member and engageable with the separate surface for defining a resonance cavity therebetween.

5. The display stand of claim 4 wherein said pad means comprises a plurality of pads mounted at spaced intervals to said second surface to define a speaker gap between each of said pads and each other of said pads.

6. The display stand of claim 5 wherein each of said pads is composed of soft or resilient material.

7. The display stand of claim 3 wherein said first opening comprises first and second portions, each of said portions having an inside diameter, said inside diameter of said first portion being larger than said inside diameter of said second portion, wherein at least a portion of said music box means is mounted in said first portion.

8. The display stand of claim 1 wherein said holder means is associated with the memorabilia.

9. The display stand of claim 1 wherein said base member has a shape associated with the memorabilia.

10. The display stand of claim 9 wherein said base member has the shape of a home plate.

11. The display stand of claim 1 further comprising mounting means for mounting said holder means to said base member and wherein said base member defines a second opening traversing said first and second surfaces, said mounting means extending through said second opening to mount said holder means to said base member.

12. The display stand of claim 11 wherein said second opening comprises first and second sections, each of said sections having an inside diameter, said inside diameter of said second section being larger than said inside diameter of said first section and defining a shoulder, and said mounting means comprises a nut and bolt, said bolt having a head engaged with said holder means and a threaded shaft extending into said second opening, said nut being disposed in said second section and engaged with said shoulder.

13. The display stand of claim 1 wherein said first surface has a decoration simulating the playing field in which said memorabilia was used.

14. The display stand of claim 13 wherein said decoration is selected from the group consisting of a baseball field, a soccer field, a football field, a basketball court, a tennis court, a hockey rink, a boxing ring, and a hole of a golf course.

15. A display stand for displaying a ball such as a baseball or a softball comprising:

a base member shaped like a home plate and having oppositely disposed first and second surfaces, said base member defining an opening traversing said first and second surfaces, said second surface being adapted to rest adjacent a separate surface;

holder means mounted to said base member adjacent said first surface for holding the ball;

a plurality of pads mounted to said second surface at spaced intervals and engageable with the separate surface for defining a resonance cavity therebetween;

music box means mounted to said base member for producing music known as Take Me Out To The Ball Game and transmitting said music to said resonance cavity via said opening.

16. The display stand of claim 15 wherein each of said pads is composed of soft or resilient material.

17. The display stand of claim 15 wherein said holder means comprises a glove.

18. The display stand of claim 15 wherein said holder means comprises a transparent sphere.

19. A display stand for displaying sports memorabilia comprising:

a base member comprising oppositely disposed first and second exterior surfaces, said second surface being adapted to rest adjacent a separate surface;

holder means mounted to said base member adjacent said first surface for holding the memorabilia; and indicia associated with the memorabilia disposed adjacent said first surface, said indicia being composed of a logo for a sports team associated with the memorabilia;

wherein said indicia and the memorabilia are simultaneously viewable from a position substantially above said first surface.

20. A display stand for displaying sports memorabilia comprising:

a base member having oppositely disposed first and second surfaces, said second surface being adapted to rest adjacent a separate surface;

indicia carried on said first surface simulating the playing field on which the memorabilia was used; and holder means mounted to said base member for holding the memorabilia.

* * * * *